United States Patent [19]

Wiedemann

[11] 4,220,697

[45] Sep. 2, 1980

[54] ELECTROPHOTOGRAPHIC RECORDING MATERIAL

[75] Inventor: Wolfgang Wiedemann, Geisenheim-Johannisberg, Fed. Rep. of Germany

[73] Assignee: Hoechst Aktiengesellschaft, Fed. Rep. of Germany

[21] Appl. No.: 928,391

[22] Filed: Jul. 27, 1978

[30] Foreign Application Priority Data

Jul. 29, 1977 [DE] Fed. Rep. of Germany ..... 2734288

[51] Int. Cl.[2] ..... G03G 5/06

[52] U.S. Cl. ..... 430/59; 430/58; 430/96

[58] Field of Search ..... 96/1.5 R, 1.6, 1.8, 96/113

[56] References Cited

U.S. PATENT DOCUMENTS

| | | | |
|---|---|---|---|
| 3,121,006 | 2/1964 | Middleton et al. | 96/1.8 X |
| 3,447,957 | 6/1969 | Behringer | 96/1.5 R X |
| 3,776,627 | 12/1973 | Ohnishi et al. | 96/1.5 R X |
| 4,072,520 | 2/1978 | Rochlitz et al. | 96/1.5 R |

OTHER PUBLICATIONS

Hackh's Chemical Dictionary, 1969, 4th Ed., p. 457.

*Primary Examiner*—Roland E. Martin, Jr.
*Attorney, Agent, or Firm*—James E. Bryan

[57] ABSTRACT

This invention relates to an improvement in an electrophotographic recording material comprising an electrically conductive support, optionally an insulating intermediate layer, and a photoconductive layer composed of at least one layer comprising charge carrier-producing and charge transporting compounds, a binder, and conventional additives, the improvement that the recording material comprises a 75 to 250 μm thick support, and, in the form of a photoconductor web, is sufficiently flexible that it is not prone to the formation of hairline cracks when repeatedly conducted over rollers of at least 12 mm diameter, said binder being a cellulose nitrate with a viscosity of 400±25 cPoises at concentrations between about 4 and 12 percent in a 5 percent aqueous acetone solution, according to DIN 53 179 (standard type 4–12).

11 Claims, 6 Drawing Figures

ELECTROPHOTOGRAPHIC RECORDING MATERIAL

Figure 1:
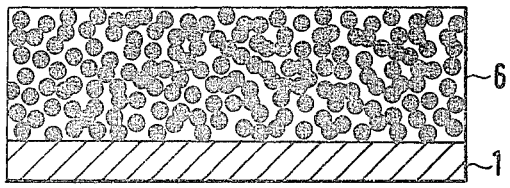

The present invention relates to an electrophotographic recording material comprising an electrically conductive support, optionally an insulating intermediate layer, and a photoconductive layer composed of at least one layer containing charge carrier-producing and charge-transporting compounds, binders, and conventional additives; in particular, the invention relates to a recording material comprising a charge carrier producing layer and a charge transport layer. Photoconductive materials comprising multiple layers are known, for example, from German Offenlegungsschriften Nos. 2,108,935, 2,108,938, 2,108,944, 2,108,958, 2,108,968, 2,108,984, and 2,108,992. While the electrophotographic properties of such layers are relatively good, the mechanical properties thereof are not satisfactory, because the normally used and mainly described polyvinyl carbazole which forms the charge transport layer is not very flexible and its compatibility and miscibility with binders and resins is poor due to its high molecular weight and chemical nature. Moreover, the adhesion of such multiple layers to the electrically conductive support is not sufficient for practical purposes. Therefore, the use of such materials so far has been limited to photoconductive systems in which they are exposed to less serious stress.

U.S. Pat. Nos. 3,973,959, 3,972,717, and 3,992,205, disclose flexible photoconductive layers of good adhesion, but even these do not meet the very high demands made of heavy duty self-supporting recording materials, e.g. photoconductor webs. Thus, when the recording material is repeatedly passed over rollers of small diameter, fine hairline cracks appear in the photoconductor surface. The high bending stress exerted upon the photoconductor layer, which, moreover, may be on a relatively thick support, causes a slow mechanical destruction of the photoconductive layer.

Furthermore, when conventional binders, such as readily soluble polyester resins or vinyl chloride/vinyl acetate copolymers are used, the photoconductive layers described have a relatively high residual charge.

It is the object of the present invention to provide an electrophotographic recording material which is highly photosensitive and whose flexibility is so modified and improved that it can be safely used even on relatively thick supports and under great mechanical stress, for example as an endless photoconductor web, and may be passed, for example, over rollers of small diameter. Furthermore, it is the object of the present invention to provide a recording material with improved discharging properties, for example during flash exposure.

For solving this problem, use is made of an electrophotographic recording material which comprises an electrically conductive support, optionally an insulating intermediate layer, and a photoconductive layer composed of at least one layer comprising charge carrier-producing and charge transporting compounds, binders, and conventional additives. The recording material comprises a 75 to 250$\mu$ thick support, and the photoconductor web is so flexible that it is not prone to the formation of hairline cracks if it is repeatedly conducted over rollers of at least 12 mm diameter. The binder used is a cellulose nitrate with a viscosity of 400±25 cPoises at concentrations between about 4 and 12 percent by weight in a 5 percent aqueous acetone according to DIN 53 179 (standard type 4–12), preferably between about 4 and 9 percent (standard type 4–9).

In this manner, an electrophotographic recording material is provided which, as compared with materials containing hitherto known conventional binders, possesses a considerably improved photosensitivity and an extremely low residual charge, both during continuous exposure and during flash exposure, in combination with good flexibility.

Due to these properties, the materials according to the invention may be used for photoconductor webs which are exposed to high mechanical stress, for example those running in copying cycles at relatively high speeds, possibly under flash exposure. In a bending stress test, the material is repeatedly, normally 5000 times, passed over rollers.

Figure 2:
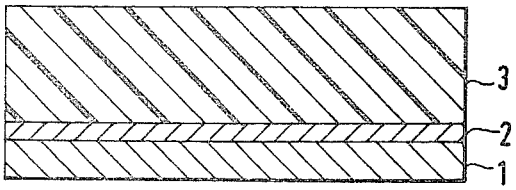
Figure 3:
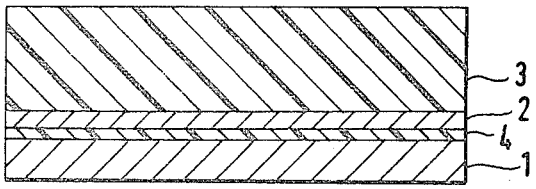
Figure 4:
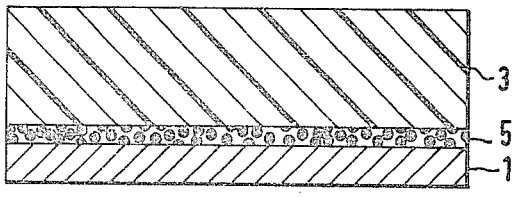
Figure 5:
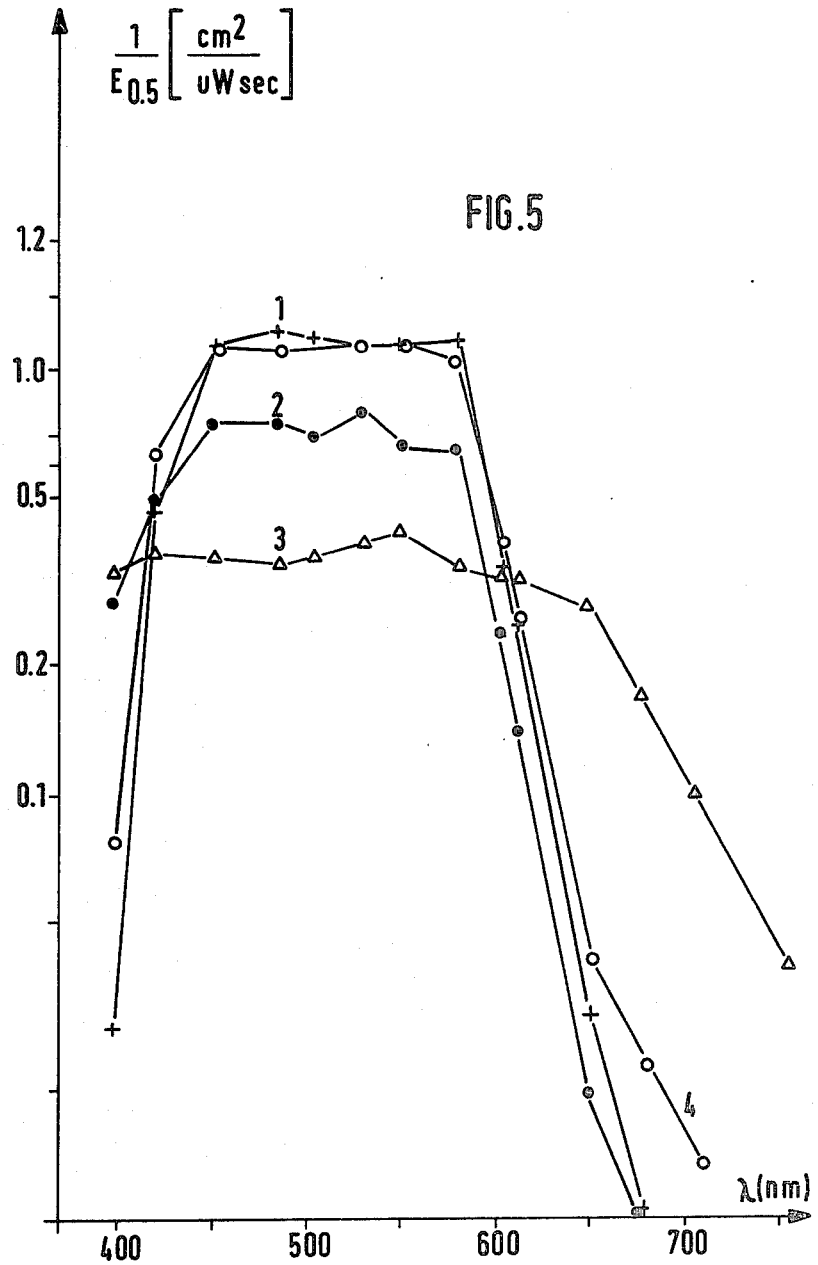
Figure 6:
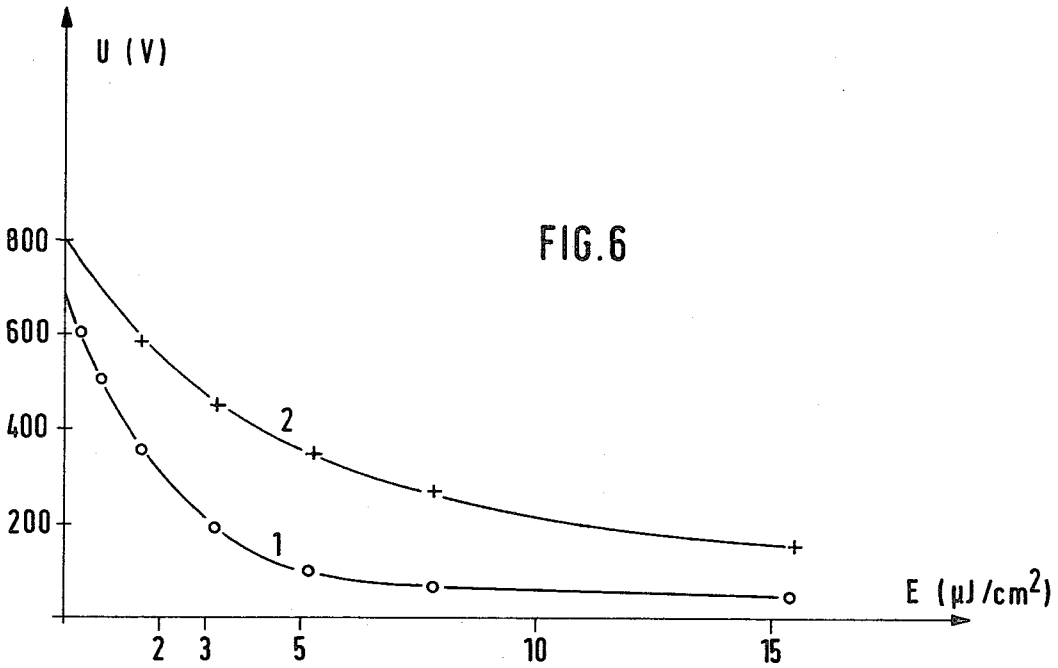

The invention will be further illustrated by reference to the accompanying drawings in which:

FIG. 1 illustrates an embodiment of the invention including a single photoconductive layer, FIGS. 2 to 4 illustrate embodiments of the invention including separate charge-carrier producing and charge transporting layers, FIG. 5 shows the curves of the spectral light-sensitivity of various photoconductor layers according to the invention, and FIG. 6 shows two curves, curve 1 showing the residual charge as a function of the energy of the flashlight, and curve 2 showing the residual charge.

An embodiment comprising a single photoconductive layer (FIG. 1) has the advantage of being more easily prepared. On the other hand, a material comprising separate charge carrier-producing and charge transport layers (FIGS. 2 to 4) provides the advantage that the particles are present in a compact arrangement and that an optimal rate of charge carrier production is achieved. Less thermally stable dyestuffs, which cannot be applied to the electrically conductive support by vacuum deposition may be used for the embodiments shown in FIGS. 1 and 4.

So far, it has not been explicitly disclosed in the development of photoconductive layers to use cellulose nitrates in any of the various known photoconductor compositions. In general descriptions of photoconductor layers, for example in the enumeration of appropriate binders, cellulose esters and cellulose ethers have been frequently mentioned (German Auslegeschrift No. 1,246,407). The highly exceptional suitability of the cellulose nitrates with regard to flexibility and photosensitivity is completely unexpected.

It is known, from German Offenlegungsschriften Nos. 2,452,622, and 2,452,623, to use cellulose nitrates, in addition to other binders, in protective layers applied to photoconductor layers, such as those disclosed, e.g., in German Auslegeschrift No. 1,572,347. These protective layers may contain substances which increase the conductivity of the layer within a resistance range of between $10^7$ and $10^9$ ohm, and also photoconductive organic substances. In view of the relatively high electrical conductivity mentioned and of the mixing ratio of up to 30 percent by weight of photoconductor, such composition are not suitable, however, for the recording material according to the invention, because, owing to their high dark conductivity, it is impossible, or at least very difficult, to apply an electrical charge thereto.

The structure of the recording material according to the invention is diagrammatically shown by the accompanying drawings in four variants. Numeral 1 in each case indicates the electrically conductive support, numeral 2 indicates the charge carrier-producing layer, numeral 3 is the charge transport layer, and numeral 4 indicates the adhesion-improving intermediate layer. Numeral 5 indicates a charge carrier-producing layer in dispersion. Numeral 6 indicates a photoconductive layer which comprises a photoconductor as the charge transporting compound, a dyestuff as the charge carrier-producing compound, and a binder, etc.

Aluminum foil, or a transparent polyester film with a vapor deposited aluminum layer thereon, or a polyester film with an aluminum layer laminated thereto, with a thickness of up to 300 μm are preferred as electrically conductive supports, but any other supporting material made sufficiently electrically conductive also may be used. The support may be either a flexible endless web, e.g. a nickel or steel web, or a plate. According to the invention, a support is used which, in the form of a web, is substantially rigid in the transverse direction and flexible and dimensionally stable in the longitudinal direction. In addition to metal bands, which fully meet these requirements at thicknesses as low as 100 to 120 μm, aluminum-vaporized polyester films of appropriate thickness, mainly in the range from 75 to 250 μm, are preferred. It was found that the greater thickness of this support is required to provide the necessary rigidity. As a consequence, the applied coating must have a correspondingly higher flexibility. If webs are used as supports, the loops required for use in high speed copying apparatuses may be formed by welding.

The insulating intermediate layer 4 may be of organic material or, if desired, of an aluminum oxide layer produced by a thermal, anodic, or chemical process. In addition to its function as an adhesion-promoting layer, the intermediate layer has the purpose of reducing by its presence the charge carrier injection from the support into the photoconductive layer in the dark. On the other hand, it does not interfere with the charge flow during the exposure process. Natural or synthetic resin binders may be used for the intermediate layer such as, e.g. polyamide resins, polyvinyl phosphonic acid, polyurethanes or polyester resins. Their thickness may be up to 5 μm, while the thickness of aluminum oxide layers is generally in the range from $10^2$–$10^4$ Å.

As the charge carrier-producing compounds, inorganic or organic substances are used which already have been used for this purpose. Examples of such compounds are dyestuffs and amorphous selenium, for example in the form of vapor-deposited layers. The spectral light-sensitivity of the photoconductive layer is particularly determined by the dyestuffs used or by the inorganic substances added, e.g. tellurium.

The application of a homogeneous, tightly packed dyestuff layer as the charge carrier-producing layer is known and is achieved by vapor-deposition of the dyestuff on the support under reduced pressure. Depending on the adjustment of the vacuum ($10^{-3}$ to $10^{-5}$ Torr at a heating temperature of between 250° and 400° C.) the dyestuffs can be vapor deposited under relatively favorable conditions without decomposition. The temperature of the support is below 50° C.

The layers thus produced are distinguished by tightly packed dyestuff molecules. This has the advantage that an optimum charge carrier production rate is achieved in the dyestuff layer, the high extinction of the dyestuffs enabling a high concentration of excited dyestuff molecules, and that the charge transport through the densely packed dyestuff layer is less impeded by binders.

Advantageously, the layer thickness of the vapor-deposited dyestuff is in the range from 0.005 to 2 μm, preferably between 0.005 and 1 μm, because adhesion and homogeneity of the vapor-deposited dyestuff are particularly favorable in this range.

Depending upon the purpose of the material, a charge carrier-producing layer of uniform thickness also may be produced by other coating techniques, for example by mechanical rubbing of the very finely pulverized material into the electrically conductive support, by chemical deposition of, e.g., a leuco base which is to be oxidized, by electrolytic or electrochemical processes, by gun-spray methods, or by application from a solution followed by drying.

As a combination of the dyestuff with materials for the insulating intermediate layer, or instead of an intermediate layer, it is also possible to produce 0.1 to 3 μm thick homogeneous dyestuff layers of good covering capacity by dispersing the dyestuff in the binder according to the invention and coating the electrically conductive support with the dispersion (layer 5 in FIG. 4). It is particularly advantageous to use high-viscosity cellulose nitrates for this purpose, because a very good distribution of the pigments during the coating process (small particle size) is achieved by the grinding process. The ratio between charge carrier producing substance and binder may vary within wide limits. Coatings with a dyestuff content of more than 50% by weight and correspondingly high optical density are preferred. In this manner, dyestuffs may be used which are less stable thermally, e.g. azodyestuffs or bisazo dyestuffs, and at the same time an adhesive effect is achieved. Dyestuffs of very different types may be used as charge carrier producing substances. The following are particularly suitable, for example:

Perylene-3,4,9,10-tetracarboxylic acid anhydride and perylene-3,4,9,10-tetracarboxylic acid imide derivatives according to German Offenlegungsschrift No. 2,237,539, polynuclear quinones according to German Offenlegungsschrift No. 2,237,678, cis- and trans- perinones according to German Offenlegungsschrift No. 2,239,923, thioindigo dyestuffs according to German Offenlegungsschrift No. 2,237,680, quinacridones according to German Offenlegungsschrift No. 2,237,679, condensation products of benzo-4,10-thioxanthene-3,1'-dicarboxylic acid anhydride and amines according to German Offenlegungsschrift No. 2,355,075, phthalocyanine derivatives according to German Offenlegungsschrift No. 2,239,924, and dyestuffs which are produced from perylene-3,4,9,10-tetracarboxylic acid anhydride and o-phenylene diamine or 1,8-diaminonaphthalene by condensation according to the method disclosed in Bull. Chem. Soc. Japan 25, 411–413 (1952).

As already mentioned, thin charge carrier producing layers composed of known inorganic substances and produced by vapor deposition of selenium, doped selenium, cadmium sulfide and the like, are also suitable.

Charge transporting compounds are used as photoconductors in the photoconductive layer, especially in the charge transport layer. Suitable compounds are, above all, organic compounds having an extended π-electron system. They include monomeric and polymeric aromatic or heterocyclic compounds.

Among the monomeric compounds, those are preferred which contain at least one dialkyl amino group or two alkoxy groups. Heterocyclic compounds, such as oxadiazole derivatives according to German Auslegeschrift No. 1,058,836, e.g. 2,5-bis-(4'-diethylaminophenyl)-oxadiazole-1,3,4, have proved to be particularly suitable. Other monomeric compounds which may be used are, for example, triphenylamine derivatives, relatively highly condensed aromatic compounds, such as pyrene, benzo-condensed heterocyclic compounds, further pyrazoline or imidazole derivatives according to German Pat. No. 1,060,714, and German Pat. No. 1,106,599. Further suitable compounds are the triazole, thiadiazole and oxazole derivatives disclosed in German Pat. Nos. 1,060,260, 1,299,296, and 1,120,875.

Among the polymeric compounds, condensation products of formaldehyde and various aromatic compounds, for example condensates of formaldehyde and 3-bromopyrene according to German Offenlegungsschrift No. 2,137,288, were found suitable.

In the absence of the charge carrier producing layer, the charge transport layer displays practically no photosensitivity in the visible range of the spectrum of about 420 to 750 nm. Preferably, it is composed of a mixture of an electron donor compound, as the photoconductor, with a resin binder, if the resulting recording material is to be negatively charged. The layer advantageously is transparent, but need not be transparent if the electrically conductive support is transparent.

The charge transport layer has a high electrical resistance and prevents the electrostatic charge from leaking away in the dark. Upon exposure, it transports the charges produced, it being assumed that, by the present invention, the higher polarity of the binder (electron-attracting nitro groups in the cellulose nitrate) lowers the polar (charged) excited state of the donor molecule and/or raises the unpolar ground state.

In addition to the charge carrier producing and the charge transporting substances contained in the layer, the binder added influences not only the mechanical behavior of the material, such as abrasion, flexibility, film formation and the like, but also the electrophotographic properties, such as photosensitivity, residual charge, etc. According to German Offenlegungsschrift No. 2,353,639, film-forming compounds, such as polyester resins, polyvinyl chloride/polyvinyl acetate copolymers, styrene/maleic acid anhydride copolymers, silicone resins, reactive resins, DD-lacequers, polycarbonates and acylates or methacrylates have been hitherto used as binders.

Surprisingly, it was found that the use of cellulose nitrates instead of the hitherto used binders leads to an essential increase and improvement with regard to elasticity and photosensitivity. In this manner, it is possible to adapt transport layers containing high-viscosity cellulose nitrates to the electrophotographic and, in particular, to the mechanical requirements of a copying apparatus, for example, an apparatus in which the web passes over rollers of small diameter.

The viscosity is determined by an Ubbelohde viscosimeter, using different capillaries I to III at a temperature of 25° C. and a solids concentration of 10 percent (DIN 51 562). It was found that the viscosity of the binder compositions in tetrahydrofuran was markedly above 50 cSt.

The mixing ratio between the charge transporting compound and the binder may vary. However, the requirement for maximum photosensitivity, i.e., as high as possible a content of charge transporting compound, on the one hand, and the necessity to prevent the compound from crystallizing out and to increase the flexibility of the material, which means as high as possible a proportion of cellulose nitrate, on the other hand, restrict the variations within relatively narrow limits.

Furthermore, films having a relatively high proportion of cellulose nitrates can be given only a relatively low charge on conductive supports; by adding charge transporting compounds, however, the charge may be successively improved and stabilized, i.e. the dark decay is reduced.

Altogether, the preferred ratio of cellulose nitrate to charge transporting compound is in the range from 20 to 60 parts by weight to 40 to 80 parts by weight. A high proportion of monomers has an adverse effect on flexibility, so that for the particularly advantageous flexible embodiments of the invention, the proportion of cellulose nitrate to charge transporting compound is in the range from 30 to 50 to 50 to 70 parts by weight.

If polymeric charge transporting compounds are used, the proportion of cellulose nitrate is in the lower region of the stated range.

If the charge transporting layers contain monomers of charge transporting compounds, e.g. 2,5-bis-(4'-diethyl-aminophenyl)oxadiazole-1,3,4, the layers are amorphous, as shown by Rontgen-Goniometer measurements.

The recording material according to the invention may be adapted within a wide range to the particular requirements of its use in a copying machine by adjusting the viscosity of the cellulose nitrate and the proportion of the charge transporting compound in the photoconductive layer.

The thickness of the photoconductive layer is in a range corresponding to a layer weight between about 5 and 50 g/m$^2$. If the photoconductive layer is in the form of a charge carrier producing layer and a charge transporting layer, layer thicknesses in the range from 0.005 to 2 $\mu$m, preferably from 0.005 to 1 $\mu$m, and in the range from 2 to 20 $\mu$m, preferably from 3 to 10 $\mu$m, are suitable. If the charge producing layer is in the form of a dispersion, layer thicknesses ranging from 0.01 to 3 $\mu$m, preferably from 0.1 to 1 $\mu$m, are advantageous.

In special cases, these limits may be extended into the higher or lower region, if the mechanical requirements and the electrophotographic parameters such as the charging and developing station of a copying apparatus do not prohibit such extension.

Conventional additives in connection with this invention are flow agents, such as silicone oils, wetting agents, especially nonionogenic substances, plasticizers of various compositions, for example those based on chlorinated hydrocarbons or on phthalic acid esters. If desired, sensitizers and/or acceptors may be added to the charge transport layer, but only to such an extent that the optical transparency of the charge transport layer is not substantially impaired by the additive.

The invention will be further illustrated by reference to the following examples:

EXAMPLE 1

At a pressure between $10^{-4}$ and $10^{-5}$ Torr and a temperature of approximately 280° C., the pigment dyestuff N,N'-dimethylperylene-3,4,9,10-tetracarboxylic acid diimide is vapor deposited for 2 minutes, in a vacuum deposition apparatus, onto an aluminum-vaporized polyester film of 75 $\mu$m thickness. The distance between the vaporizer source and the substrate is about 20 cm. The vapordeposited homogeneous dyestuff layer has a thickness corresponding to a layer weight of 100–200 mg/m$^2$, and the support is completely covered by the layer.

For each sample, a tetrahydrofuran (THF) solution containing equal parts by weight of 2,5-bis-(4'-diethylaminophenyl)oxadiazole-1,3,4 (To) (melting point 149°–150° C.) and a cellulose nitrate is whirler-coated onto this layer. Cellulose nitrates are collodion cottons which are deactivated by the addition of 35 parts by weight of n-butanol or water (safety moistening). A covering layer of the above mentioned composition thus contains about 60 parts by weight of photoconductive To and 40 parts by weight of cellulose nitrate.

After drying the layer for about 5 minutes at 110° C., it has a thickness of about 10 μm. A high-viscosity, ester-soluble collodion cotton and a low-viscosity, alcohol-soluble collodion cotton were used for the tests.

In the following table, the photosensitivity of layers according to the invention is compared with that of highly light-sensitive known organic photoconductor layers; the comparable photoconductive double layer material has a dyestuff coating of a thickness corresponding to about 150 mg/m$^2$.

The photosensitivity is measured as follows:

For determining its light discharge curve, the sample to be measured is moved, on a rotating plate, through a charging station to the exposure station where it is continuously exposed to the light of a xenon lamp type XBO 150 marketed by Messrs. Osram. A heat-absorbing glass of type KG 3, marketed by Messrs. Schott and Gen., Mainz, Germany, and a neutral filter with 15% transparency are attached to the lamp. The light-intensity in the measuring plane is in the range from 70 to 170 μW/cm$^2$; it is measured immediately after the light decay curve has been determined with the aid of an Opto-Meter model type -80X (United Detector Technology Inc.). The voltage of the charge ($U_0$) and the photoinduced light decay curve are oscillographically recorded, by an electrometer of type 610 CR, marketed by Keithly Instruments, USA, and a transparent probe. The photoconductor layer is characterized by the voltage of the charge ($U_0$) and by the time ($T\frac{1}{2}$) after which the charge has been reduced to half its original value ($U_0/2$). The product of $T\frac{1}{2}$ and the measured light-intensity I (μW/cm$^2$) is the half-value energy $E\frac{1}{2}$ (μJ/cm$^2$).

The photosensitivity of the following materials was determined by this characterizing method:

| Charge transport layer | Thickness of layer (μm) | Curves in FIG. 5 | $(-)U_o$ (V) | $E\frac{1}{2}$ (μJ/cm$^2$) |
|---|---|---|---|---|
| polyvinylcarbazole/ 2,4,7-trinitrofluorenone (molar ratio 1:1) | 12 | 3 | 750 | 4.5–5 |
| photoconductive double layer, To and PVC/ PVAc-copolymer ratio by weight 50:50 | 9–10 | 2 | 850 | 3.8 |
| ratio by weight 60:40 | 10 | | 885 | 3.7 |
| To and low viscosity cellulose nitrate, ratio by weight 60:40 | 10 | 1 | 810 | 2.2 |
| To and high viscosity cellulose nitrate, ratio by weight 60:40 | 9–10 | 4 | 805 | 2.2 |

The spectral light-sensitivity is determined by the same method using filters:

The material is negatively charged and then the half-value time ($T\frac{1}{2}$ in msec) for the wave length range in question is determined by exposure. By plotting the reciprocal values of the product of half-value time, $T\frac{1}{2}$ in seconds, and light-intensity I, in μm/cm$^2$ against the wave length λ in nm, the spectral lightsensitivity is obtained. The reciprocal value of $T_{1/2} \cdot I(1/E_{1/2})$ is the light energy, per unit area, which must be irradiated to discharge the layer to half its original voltage $U_0$.

FIG. 5 shows the curves of the spectral light-sensitivity of the photoconductor layers listed in the table. These curves also prove the high photosensitivity of the material according to the invention.

EXAMPLE 2

75 μm thick aluminum-vaporized polyester film with a dyestuff layer applied thereto by vacuum deposition, as described in Example 1, is coated, under comparable conditions, to a thickness of 8 to 10 μm with a series of charge transport layers containing cellulose nitrates of different viscosities. The composition of the dried layer is in each case 60 parts to To and 40 parts of the particular cellulose nitrate used, the cellulose nitrates differing from each other by their degree of viscosity and extending over a standard type range from 15 to 4, according to DIN 53 179.

The layers are checked for their mechanical properties in a cone test apparatus (1), adhesion to the support and formation of hairline cracks being judged. While the adhesion of all layers is good, the formation of superficial cracks of different lengths strongly depends on the viscosity of the cellulose nitrate employed.

| Photoconductor Layers containing collodion cotton (Dynamit Nobel AG) Type | Length of Hairline Cracks (mm) Cone Test | Determination of Viscosity by Ubbelohde (5% by weight in THF at 25° C.) according to DIN 51 562 |
|---|---|---|
| NP 180 | 19 | 27.1 cSt. |
| HP 180 | 22 | |
| HP 350 | 10 | 97 cSt. |
| HP 800 | 0 | 278 cSt. |
| HP 3000 | 0 | 645 cSt. |
| HP 25000 | 0 | 111.5 cSt(2) |

EXAMPLE 3

A dyestuff layer as described in Example 1 is applied to polyester films of 75 μm, 125 μm, and 190 μm thickness, respectively, which were made conductive by a vapor deposited aluminum layer. Identical charge transport layers consisting of 65 parts by weight of To and 35 parts by weight of high-viscosity cellulose nitrate are then applied, to a thickness of 7.0–9.5 g/m$^2$ to the dyestuff layers under identical conditions, and dried.

Each of these materials is formed into a loop either by cementing or by welding together, and the loops are subjected to a bending stress test. For this purpose, the flexible loop is passed many times over rollers of varying diameters. It is caused to revolve over a driven rubber roller with a diameter of about 80 mm and over an exchangeable steel roller whose diameter may be 12, 18, or 25 mm. In a standard test, the loop is passed 5000 times over these rollers at a constant speed of revolution. With decreasing diameter of the rollers and increasing thickness of the support, the bending stress exerted upon the photoconductor layer increases, so that the number of hairline cracks appearing on the surface increases. Advantageously, the formation of these hairline cracks is observed in the dark, with the aid of slanting light.

It was found that absolutely no hairline cracks appeared in the top layer of the described composition under this severe bending stress at roller diameters of 18 mm and 12 mm and the support thicknesses stated above.

In the case of known photoconductor layers containing polyester resins or vinyl chloride/vinyl acetate copolymers as binders, however, a distinct differentiation is observed with regard to the thickness of the support and also the diameter of the roller. This is described in the following:

Analogously to the preparation described in the previous examples, a charge transport composition consisting of 50 parts by weight to To, 25 parts by weight of a polyester resin, and 25 parts by weight of a vinyl chloride/vinyl acetate copolymer is applied as a layer weighing 9 to 10 g/m$^2$ to a dyestuff layer as in Example 1 and subjected to a bending stress test. At a roller diameter of 25 mm and after 5000 revolutions, no hairline cracks appear in the photoconductive layer applied to a 75 μm thick polyester film; the layer applied to a polyester film of 125 μm thickness shows a few isolated, short hairline cracks, and the layer applied to a 190 μm thick polyester film shows very marked, long hairline cracks. Moreover, it was noted that at a roller diameter of 18 mm, the layer applied to a 75 μm thick support also showed a few isolated hairline cracks.

EXAMPLE 4

The following dyestuffs, and selenium, are applied as described in Example 1 to aluminum-vaporized polyester films of 75 μm thickness in a manner such that the resulting layers have a thickness corresponding to a weight of 100–200 mg/m$^2$.

In order to show the improvement of the photoconductor properties by the presence of cellulose nitrates, cellulose nitrates of different viscosities are used together with To and are applied to the same charge carrier producing layers as the charge transport layers containing known binders, e.g. polyester resins, PVC/PVAc copolymers and To to which they are compared.

Coating and drying are performed under comparable conditions (see Example 1) except in the case of the selenium layer which is dried for 3 minutes at 85° C., and the thickness of the resulting charge transport layer is 8 to 10 μm, the proportion by weight between To and binder is 1:1.

Likewise, the measuring conditions correspond to those used in Example 1, the light intensity (Xenon lamp type XBO 150) of one test series being approximately 150 μW/cm$^2$, that of another approximately 80 to 85 μW/cm$^2$, a charge in the range from 600 to 700 V being desired. As an additional criterion for the photosensitivity, besides the half-value time, the residual charge is determined which is present after 0.1 second.

The test series are listed in the following table, the top layers consisting of:

1 = To and cellulose nitrate, the viscosity increasing from a to c,

2 = To and a vinyl chloride/vinyl acetate copolymer,

3 = To and a polyester resin.

TABLE 1

| Dyestuff Layer | Transport Layer | $(-)U_o$(V) | $T_{178}$ (msec) | $U_R$ after 100 msec | Remarks |
|---|---|---|---|---|---|
| N,N'-dimethyl-peryl-imide (C.I. 71 130) | 1 a | 610 | 14 | 60 | Light Intensity approximately 150 μW/cm$^2$ |
| | 2 | 615 | 32 | 160 | |
| | 3 | 625 | 29 | 165 | |
| Selenium | 1 a | 650 | 20 | 95 | Lower drying temperature, about 3 minutes at 85° C. |
| | 2 | 640 | 28 | 190 | |
| | 3 | 700 | 27 | 180 | |
| Metal-free Phthalocyanine (C.I. 74 100) | 1 a | 590 | 20 | 75 | |
| | 2 | 695 | 35 | 210 | |
| | 3 | 650 | 50 | 240 | |
| Tetrachlorothioindigo-Pigment (C.I. Pigment Red 88) | 1 a | 655 | 34 | 140 | |
| | 2 | 630 | 44 | 200 | |
| | 3 | 650 | 44 | 195 | |
| Dibromoanthanthrone (C.I. 59 300) | 1 a | 520 | 21 | 75 | |
| | 2 | 660 | 27 | 180 | |
| | 3 | 625 | 27 | 150 | |
| Quinacridone (C.I. 46 500) | 1 b | 620 | 72 | 235 | Light Intensity 80–85 μW/cm$^2$ |
| | 2 | 605 | 95 | 295 | |
| | 3 | 620 | 164 | 405 | |
| Benzothioxanthene-Derivative | 1 b | 625 | 58 | 195 | Condensation product of benzo-4,10-thioxanthene-3,1'-dicarboxylic acid anhydride and o-phenylenediamine |
| | 2 | 620 | 72 | 250 | |
| | 3 | 610 | 68 | 220 | |
| Trans-Perinone (C.I. 71 105) | 1 c | 615 | 42 | 115 | |
| | 2 | 610 | 67 | 220 | |
| | 3 | 605 | 62 | 210 | |

EXAMPLE 5

A condensation product of 3-bromopyrene and formaldehyde prepared in accordance with German Offenlegungsschrift No. 2,137,288, was found to be very suitable as a polymeric charge transporting substance. If it is combined with cellulose nitrate, a photosensitivity may be obtained which is markedly improved over that of a combination of the same condensation product with a known binder, e.g. a polyester resin.

A material which had been prepared in accordance with Example 1 and provided with a dyestuff layer is coated with a 6 to 7 μm thick charge transport layer consisting of 80 parts by weight of bromopyrene resin and 20 parts by weight of low-viscosity cellulose nitrate. For comparison, an analogous material is prepared in which the 6 to 7 μm thick charge transport layer consists of 80 parts by weight of the bromopyrene resin and 20 parts by weight of a polyester resin.

When measuring the sensitivity, the following values result:

| | (−) $U_o$ (V) | $E_{\frac{1}{2}}$ (μW/cm²) |
|---|---|---|
| Bromopyrene resin/cellulose nitrate | −480 | 3.6 |
| Bromopyrene resin/polyester resin | −850 | 4.6 |

EXAMPLE 6

A charge transport layer consisting of equal parts by weight of To and, in one case, a high-viscosity cellulose nitrate and, in the other case, a low-viscosity cellulose nitrate was applied as a layer weighing 9 to 10 g/m² to a 100 μm thick polyester film (optical quality).

Upon measuring the surface resistance by a spring contact electrode (VDE 0303, part 3/3.67) at a measurement voltage of approximately 100 V, the following resistance values result for these covering layers:

high viscosity cellulose nitrate: $5.6\times10^{12}$ ohm
low viscosity cellulose nitrate: $3.0\times10^{12}$ ohm

EXAMPLE 7

For the preparation of a very flexible photoconductor layer, a dyestuff layer is vapor deposited as in Example 1 and a charge transport layer consisting of 65 parts by weight of To and 35 parts by weight of high viscosity cellulose nitrate and weighing 8.1 g/m² (≧6.3 μm) is coated onto the dyestuff layer and dried. The dark decay and flash sensitivity of the material are tested.

The dark decay of a sample of the photoconductor material is measured in a Dyntest-90 apparatus (Paper Analyzer) marketed by ECE, Giessen, Germany. For this purpose, the sample to be measured is fastened to a rotating disc (n=1390 revolutions per minute) where it is intermittently charged. When a certain, predetermined charge has been reached, the charging corona is switched off and the dark decay during 20 seconds is measured. A measuring probe measures the charge ($U_0$) or the voltage drop ($\Delta U_D$), which is recorded by a recorder. The voltage drop in the dark after 2 seconds is measured within the charge range in question:

| | |
|---|---|
| (−) $U_o$ = 550 V | $\Delta U_D$ approximately 65 V |
| (−) $U_o$ = 450 V | $\Delta U_D$ approximately 30 V. |

The discharge behavior of the material during flash exposure is determined by mounting the sample in conductive contact upon an aluminum plate, charging it, and introducing it into the measuring station. In this station, the photoconductive layer is exposed to a compact xenon arc lamp (flash tube type Strobotac 1538-A, marketed by General Radio) under a transparent charging probe. The charges measured by the charging probe are reinforced and recorded by a recorder.

Wave length and light energy may be varied by interposing interference and gray filters into the light path. Provided the energy of the flash lamp is sufficiently constant, the light energy may be directly determined after removing the sample of the photoconductor material from the path of rays (UDT-80 X Opto-Meter, see also Example 1).

After a constantly adjusted charge has been attained (range of field intensity from 10 to 10.7 V/μm), the sample is exposed to a defined flash energy (constant duration of the flash 3 μs) and the residual charge is measured after 1 second. In curve 1 of FIG. 6, the residual charge U (V) is shown as a function of the energy E (μJ/cm²) of the flash light. From these curves, the half-value energy ($E_{1/2}$) may be determined at which the photoconductor layer has discharged to half its original charge. The sample according to the invention has a half-value energy $E_{1/2}=1.7$ μJ/cm² (U=(−) 675 V; electrical field intensity 10.7 V/μm.)

For comparison, a photoconductive system was measured under the same conditions whose charge transport layer is 7 to 9 μm thick and consists of 50 parts by weight of To, 25 parts by weight of a polyester resin, and 25 parts by weight of a vinyl chloride/vinyl acetate copolymer. With an electrical field intensity of 10.2 V/μm, the half-value energy is $E_{1/2}=4.1$ μJ/cm². This shows that the photosensitivity of the material according to the invention is considerably improved. The curve of the residual charge is as shown in FIG. 6 at 2.

EXAMPLE 8

The following test series serves to show the dependence of the dark decay ($U_0$) on the charge transporting substance or on the cellulose nitrate content of the covering layer.

A material prepared as described in Example 1 and coated with a dyestuff layer is whirler-coated with tetrahydrofuran solutions containing varying amounts of To in high viscosity cellulose nitrate. The thickness of the layers thus produced corresponds to a weight of 7–8 g/m².

The dark decay is measured as described in Example 7.

| To (% by weight) | (−) $U_o$(V) | $U_D$ after 2 seconds |
|---|---|---|
| 28 | 410 | 145 |
| 40 | 420 | 145 |
| 60 | 410 | 45 |
| 65 | 420 | 50 |
| 78 | 405 | 10 |

EXAMPLE 9

The dyestuff used in Example 1 is suspended, at a rate of about 1 percent (0.7 g) and at a rate of 5 percent (based on the solids content), in an about 7 percent tetrahydrofuran solution containing 44 parts by weight of To and 36 parts by weight of deactivated (safety moistened) cellulose nitrate (ratio of cellulose nitrate to n-BuOH=65:35).

This composition is first adjusted to an about 25 percent concentration and the dyestuff is then thoroughly ground in a ball mill (Perl Mill PM 1, a product of Draiswerke, Mannheim). Subsequently, the solution was rediluted to the above-identified concentration and the dyestuff-dispersion was homogeneously coated as in FIG. 1 onto an aluminum-vaporized, 75 μm thick polyester film. The resulting layer, which had a weight of approximately 7 g/m², was then dried.

The photosensitivity was measured analogously to the measuring method described in Example 1 (light intensity about 90 μW/cm², xenon lamp type XBO 150):

| Dyestuff | Layer Weight g/m² | $U_o$(V) | $E_{\frac{1}{2}}$ (μJ/cm²) |
|---|---|---|---|
| 1% | 6.8 | (−) 425 | 11.5 |
| 5% | 7.1 | (−) 525 | 9.4 |

EXAMPLE 10

A composition is prepared comprising equal parts by weight of deactivated high-viscosity cellulose nitrate and a perinone dyestuff (Hostaperm Orange GR) in tetrahydrofuran and is thoroughly ground for 2 hours. After dispersion, the solution is diluted to four times its original quantity and the resulting, about 1 percent concentration coating solution is homogeneously applied to a 75 μm thick aluminum-vaporized polyester film and dried.

A pigment coating is thus produced whose layer thickness is 255 mg/m² in one case and 50 mg/m² in the other; pigment and cellulose nitrate are contained in the coating in a proportion of 60:40 by weight. Identical charge transport layers weighing about 8 g/m² and comprising 65 parts by weight of To and 35 parts by weight of high viscosity cellulose nitrate are then applied to the two pigment coatings of different thickness and dried.

The sensitivity is determined as described in Example 1 (light-intensity approximately 85 μW/cm²; xenon lamp type XBO 150).

| Perinone coating (mg/m²) | (−)$U_o$(V) | $E_{\frac{1}{2}}$ (μJ/cm²) |
|---|---|---|
| 255 | 625 | 4.3 |
| 50 | 575 | 5.3 |

EXAMPLE 11

A pigment coating containing 2 parts by weight of a polynuclear quinone (Hostaperm Scarlet GO) and 1 part by weight of deactivated high viscosity cellulose nitrate is dispersed as described in Example 10 and applied, as layers of varying thicknesses, to suitable supports. Then a layer weighing approximately 7 g/m² and comprising 70 parts by weight of To and 30 parts by weight of low viscosity cellulose nitrate is applied to the coating.

The photosensitivity is determined as described in Example 1 and yields the following values for the pigment coatings differing in thickness (light intensity 80 μJ/cm², xenon lamp type XBO 150):

| Quinone Coating mg/m² | (−) $U_o$(V) | $E_{\frac{1}{2}}$ (μJ/cm²) |
|---|---|---|
| 540 | 575 | 4.4 |
| 160 | 650 | 6.9 |

EXAMPLE 12

A condensation product obtained by reacting perylene-3,4,9,10-tetracarboxylic acid anhydride with o-phenylene diamine as disclosed in German Offenlegungsschrift No. 2,314,051, is vapor deposited as in Example 1 onto a 190 μm thick aluminum-vaporized polyester film. The weight of the homogeneous, bluish-violet dyestuff layer is 195 mg/m².

The resulting film is then coated with a layer comprising 65 parts by weight of To and 35 parts by weight of high viscosity cellulose nitrate. A layer which had been prepared for comparison with a vinyl chloride/vinyl acetate copolymer (PVC/PVAc) yields a system of relatively poor photosensitivity when applied to the same vapor-deposited dyestuff layer.

The photosensitivity is measured as described in Example 1 (light-intensity 90 μW/cm², xenon lamp type XBO 150):

| Binder | Layer Weight g/m² | (−) $U_o$(V) | $E_{\frac{1}{2}}$ (μJ/cm²) |
|---|---|---|---|
| cellulose nitrate | 7–8 | 525 | 1.6 |
| PVC/PVAc | 9 | 500 | 3.5 |

It will be obvious to those skilled in the art that many modifications may be made within the scope of the present invention without departing from the spirit thereof, and the invention includes all such modifications.

What is claimed is:

1. In an electrophotographic recording material comprising an electrically conductive support, optionally an insulating intermediate layer, and a photoconductive layer composed of at least one layer comprising charge carrier-producing and charge transporting compounds, a binder, and conventional additives, the improvement that the recording material comprises a 75 to 250 μm thick support, and, in the form of a photoconductor web, is sufficiently flexible that it is not prone to the formation of hairline cracks when repeatedly conducted over rollers of at least 12 mm diameter, said binder being a cellulose nitrate with a viscosity of 400±25 cPoises at concentrations between about 4 and 12 percent by weight in a 5 percent aqueous acetone solution, according to DIN 53 179 (standard type 4–12), the proportion of cellulose nitrate to charge transporting compound being in the range of about 20 to 60 parts by weight to 40 to 80 parts by weight.

2. A recording material according to claim 1 in which the cellulose nitrate has a viscosity of 400±25 cPoises at concentrations between about 4 and 9 percent in 5% aqueous acetone solution, according to DIN 53 179 (standard type 4–9).

3. A recording material according to claim 1 comprising a sequence of layers of a 75 to 250 μm thick electrically conductive support of an aluminum-vaporized polyester film, a charge-producing dyestuff layer of 0.005 to 2 μm thickness, and a 2 to 20 μm thick charge transport layer composed of about 40 to 80 parts by weight of a monomeric organic charge transporting substance and 20 to 60 parts by weight of cellulose nitrate as the binder.

4. A recording material according to claim 3 comprising a 75 to 250 μm thick electrically conductive support of aluminum-vaporized polyester film, a charge-producing dyestuff layer of 0.005 to 1 μm thickness, and a 3 to 10 μm thick charge transport layer comprising about 50 to 70 parts by weight of a monomeric organic charge-transporting substance and 30 to 50 parts by weight of cellulose nitrate as the binder.

5. A recording material according to claim 1 in which the charge carrier-producing layer contains cellulose nitrate.

6. A recording material according to claim 1 in which the photoconductive layer contains at least one monomeric or polymeric aromatic or heterocyclic compound as the charge transporting substance.

7. A recording material according to claim 6 in which the photoconductive layer comprises a monomeric heterocyclic compound which is substituted by at least one dialkylamino group.

8. A recording material according to claim 6 in which the heterocyclic compound is an oxadiazole.

9. A recording material according to claim 8 in which the heterocyclic compound is 2,5-bis-(4'-diethylaminophenyl)-oxadiazole-1,3,4.

10. A recording material according to claim 6 in which the photoconductive layer comprises a relatively highly condensed aromatic compound.

11. A recording material according to claim 10 in which the relatively highly condensed aromatic compound employed is a condensation product of formaldehyde and 3-bromopyrene.

* * * * *

UNITED STATES PATENT AND TRADEMARK OFFICE

CERTIFICATE OF CORRECTION

PATENT NO. : 4,220,697

DATED : September 2, 1980

INVENTOR(S) : Wolfgang Wiedemann

It is certified that error appears in the above—identified patent and that said Letters Patent is hereby corrected as shown below:

Column 2, line 62, "composition" should read - - - compositions - - -;

Column 5, line 48, "DD-Lacequers" should read - - - DD-lacquers - - -;

Column 5, line 49, "acylates" should read - - - acrylates - - -;

Column 8, line 24, "to" should read - - - of - - -;

Column 8, after the table in lines 36 to 46, the following has been omitted:

- - - 1) The cone test apparatus may be used for determining gradual differences in the flexibility behavior of photoconductive layers. For this purpose, a 110 mm wide sample of photoconductor material is drawn with its dust-free back under a tension of 0.5 kp over a metal cone attached to a tripod (the tip of the cone has a diameter of 3 mm, its base a diameter of 30 mm; the total length of the cone axis is 115 mm, and it is horizontally arranged). The maximum length of the hairline cracks formed (e.g. 30 mm) indicates the smallest diameter to be embraced (e.g. 10 mm).

2) 2 per cent by weight. - - -;

Column 9, line 19, "to" should read - - - of - - -;

Columns 9/10, in the headings for Table I, "$T_{178}$" should read - - - $T_{1/2}$ - - -.

Signed and Sealed this

*Twenty-fifth* Day of *November 1980*

[SEAL]

*Attest:*

SIDNEY A. DIAMOND

*Attesting Officer*

*Commissioner of Patents and Trademarks*